US010710031B2

(12) United States Patent
Rudick

(10) Patent No.: US 10,710,031 B2
(45) Date of Patent: Jul. 14, 2020

(54) BEVERAGE DISPENSER SYSTEM WITH INTEGRATED CARBONATOR

(71) Applicant: The Coca-Cola Company, Atlanta, GA (US)

(72) Inventor: Arthur G. Rudick, Atlanta, GA (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 15/753,048

(22) PCT Filed: Aug. 15, 2016

(86) PCT No.: PCT/US2016/047012

§ 371 (c)(1),
(2) Date: Feb. 15, 2018

(87) PCT Pub. No.: WO2017/031047

PCT Pub. Date: Feb. 23, 2017

(65) Prior Publication Data

US 2018/0236414 A1 Aug. 23, 2018

Related U.S. Application Data

(60) Provisional application No. 62/207,094, filed on Aug. 19, 2015.

(51) Int. Cl.

| | |
|---|---|
| ***B01F 3/04*** | (2006.01) |
| ***B01F 5/04*** | (2006.01) |
| ***B67D 1/00*** | (2006.01) |

(52) U.S. Cl.

CPC ..... *B01F 3/04503* (2013.01); *B01F 3/04808* (2013.01); *B01F 3/04815* (2013.01);
(Continued)

(58) Field of Classification Search

CPC ..... B01F 3/04503; B01F 3/04808; B01F 3/04815
(Continued)

(56) References Cited

U.S. PATENT DOCUMENTS 3,215,312 A 11/1965 Guzzi
3,378,170 A * 4/1968 Reynolds ..... A23G 9/045 222/129.4
(Continued)

FOREIGN PATENT DOCUMENTS

DE 202006004851 U1 6/2006
EP 1338552 A1 8/2003
(Continued)

OTHER PUBLICATIONS

International Search Report and Written Opinion for PCT/US2016/047012, dated Nov. 16, 2016.
(Continued)

*Primary Examiner* — Vishal Pancholi
(74) *Attorney, Agent, or Firm* — Merchant & Gould P.C.

(57) ABSTRACT

A chilling reservoir for providing in-line carbonation in a beverage dispenser includes a housing having a first beverage material pathway extending therethrough. The first beverage material pathway may have a flow inlet arrangement and a flow outlet arrangement. The chilling reservoir also includes a heat exchanger arrangement that is positioned and configured to be selectively operated to chill beverage material passing through the first beverage material pathway. The chilling reservoir also includes a carbonation chamber operably positioned in the first beverage material pathway of the housing. The carbonation chamber may be configured to removably receive therein a carbonator.

18 Claims, 4 Drawing Sheets

(52) U.S. Cl.
CPC ..... *B01F 5/0476* (2013.01); *B67D 1/0058* (2013.01); *B67D 1/0064* (2013.01); *B67D 1/0067* (2013.01); *B67D 1/0072* (2013.01); *B01F 2003/049* (2013.01); *B67D 1/0021* (2013.01); *B67D 2210/00044* (2013.01)

(58) Field of Classification Search
USPC ..... 222/129.1–129.4, 145.6, 146.1, 146.6, 222/189.07–189.11, 190
See application file for complete search history.

(56) References Cited

U.S. PATENT DOCUMENTS

| | | | | |
|---|---|---|---|---|
| 3,813,010 | A * | 5/1974 | Hassell | B01F 3/04815 222/129.1 |
| 4,927,567 | A | 5/1990 | Rudick | |
| 7,305,847 | B2 * | 12/2007 | Wolski | B67D 1/0003 222/146.6 |
| 7,513,122 | B2 | 4/2009 | Wolski et al. | |
| 8,485,394 | B2 | 7/2013 | Tachibana et al. | |
| 8,807,393 | B2 | 8/2014 | Carpenter et al. | |
| 2005/0011910 | A1 | 1/2005 | McCann et al. | |
| 2011/0041543 | A1 * | 2/2011 | Tachibana | A23L 2/54 62/389 |
| 2013/0062366 | A1 * | 3/2013 | Tansey | A47J 31/44 222/102 |
| 2013/0256333 | A1 * | 10/2013 | Doelman | B67D 1/0082 222/1 |
| 2014/0239521 | A1 | 8/2014 | Ergican et al. | |
| 2014/0263406 | A1 | 9/2014 | Green et al. | |
| 2015/0315006 | A1 | 11/2015 | Ziesel | |

FOREIGN PATENT DOCUMENTS

| | | | |
|---|---|---|---|
| EP | 1731479 | A1 | 12/2006 |
| GB | 2261383 | A | 5/1993 |
| WO | 2015/175494 | A1 | 11/2015 |
| WO | 2016/168644 | A1 | 10/2016 |

OTHER PUBLICATIONS

European Search Report for Application No. 16837645.7 dated Mar. 15, 2019.

* cited by examiner

BEVERAGE DISPENSER SYSTEM WITH INTEGRATED CARBONATOR

This application is a National Stage application of PCT International Patent Application No. PCT/US2016/047012, filed Aug. 15, 2016, which claims priority to U.S. Provisional patent application Ser. No. 62/207,094, filed Aug. 19, 2015, which applications are incorporated herein by reference. To the extent appropriate, a claim of priority is made to each of the above disclosed applications.

BACKGROUND

Carbonation apparatuses make and dispense carbonated water for a carbonated beverage dispensing system. A typical carbonation apparatus uses a batch process to carbonate a water source. One example beverage dispensing system with a batch process is disclosed in U.S. patent application Ser. No. 14/200,073; the complete disclosure of this reference being incorporated herein by reference.

In a typical batch process, uncarbonated or still water is often supplied to a mixing tank from a source, normally through some type of pump assembly, with a depth of the water being controlled in response to demand. Water in a carbonator tank is mixed with carbon dioxide gas from a pressurized source. The carbon dioxide gas is absorbed in the water to form carbonated water, which is delivered to a dispensing valve. The carbonated water is then mixed with a measured amount of additives (e.g., beverage concentrate or syrup) to provide a carbonated beverage.

SUMMARY

It should be appreciated that this Summary is provided to introduce a selection of concepts in a simplified form that are further described below in the Detailed Description. This Summary is not intended to be used to limit the scope of the claimed subject matter.

According to one embodiment disclosed herein, a chilling reservoir for a beverage dispenser is provided. The chilling reservoir includes a housing defining a first beverage material pathway extending therethrough. The first beverage material pathway may have a flow inlet arrangement and a flow outlet arrangement. The chilling reservoir also includes a heat exchanger arrangement that is positioned and configured to be selectively operated to chill beverage material passing through the first beverage material pathway. The chilling reservoir also includes a carbonation chamber operably positioned in the first beverage material pathway of the housing. The carbonation chamber may be configured to removably receive therein a carbonator.

According to another embodiment disclosed herein, a beverage dispensing system is provided. The beverage dispensing system includes a dispenser having a nozzle. The beverage dispensing system includes a pump in fluid communication with each of the at least one macro-ingredient reservoir and the at least one micro-ingredient reservoir in the dispenser. The beverage dispensing system also includes a chilling reservoir having at least one beverage material pathway extending therethrough with a flow inlet arrangement and a flow outlet arrangement. The chilling reservoir is positioned and configured to be selectively operated to chill beverage material passing through the at least one beverage material pathway. The beverage dispensing system also includes a carbonation chamber operably positioned in the at least one beverage material pathway of the chilling reservoir. The beverage dispensing system also includes a carbonator including a water input in communication with a flow of water, a gas input in communication with a flow of gas, and a carbonated water output in fluid communication with the nozzle. The carbonation chamber may be configured to removably receive therein the carbonator. The beverage dispensing system may optionally include at least one macro-ingredient reservoir and at least one micro-ingredient reservoir in fluid communication with the nozzle.

According to yet another embodiment disclosed herein, a method of dispensing a beverage is provided. The method includes providing a dispenser with an integrated carbonation system having a carbonator and a nozzle. The method includes pumping carbon dioxide and water through the carbonator on opposite sides thereof. The method includes mixing carbon dioxide and water in the carbonator such that carbonation occurs while dispensing a chosen beverage to the nozzle.

The features, functions, and advantages that have been discussed can be achieved independently in various embodiments of the present disclosure or may be combined in yet other embodiments, further details of which can be seen with reference to the following description and drawings.

BRIEF DESCRIPTION OF THE DRAWINGS

The embodiments presented herein will become more fully understood from the detailed description and the accompanying drawings, wherein.

The plurality of figures presented in this application illustrates variations and different aspects of the embodiments of the present disclosure.

DETAILED DESCRIPTION

Aspects of this patent application relate to providing chilled carbonated water in a beverage dispenser. Beverage dispensers for soft drinks, sports drinks, juices, waters, and the like, generally include a device for producing carbonated water. A common device for producing and storing carbonated water is a carbonator. Typically, carbonators include a pressurized tank, a plain water inlet, a carbon dioxide gas inlet, and a carbonated water outlet. Many carbonators include steel containment vessels to maintain high pressures.

In a batch process, still water and carbon dioxide gas may be mixed together inside a pressurized tank to make carbonated water. The carbonated water generally remains in the pressurized tank until drawn upon. Upon actuation of a pour button by a user, the carbonated water may be drawn from the tank and dispensed in a cup. In a low duty cycle, the carbonated water may sit in the tank for an extended period of time and may become stale. As such, stale water may be dispensed when still water is carbonated in a batch process as opposed to being carbonated in-line as a continuous stream process. An in-line continuous carbonator can be less expensive than a batch carbonator.

In a typical beverage dispenser, various beverage components or ingredients may be selectively added to the carbonated water to dispense a chosen carbonated beverage in the cup. Typically for a batch process, the amount of carbonation introduced in the beverage is not customizable (i.e., is not readily varied from dispensing to dispensing).

Improvements over the batch process are desired to provide a system in which the water is carbonated in-line as a continuous stream.

Figure 1:
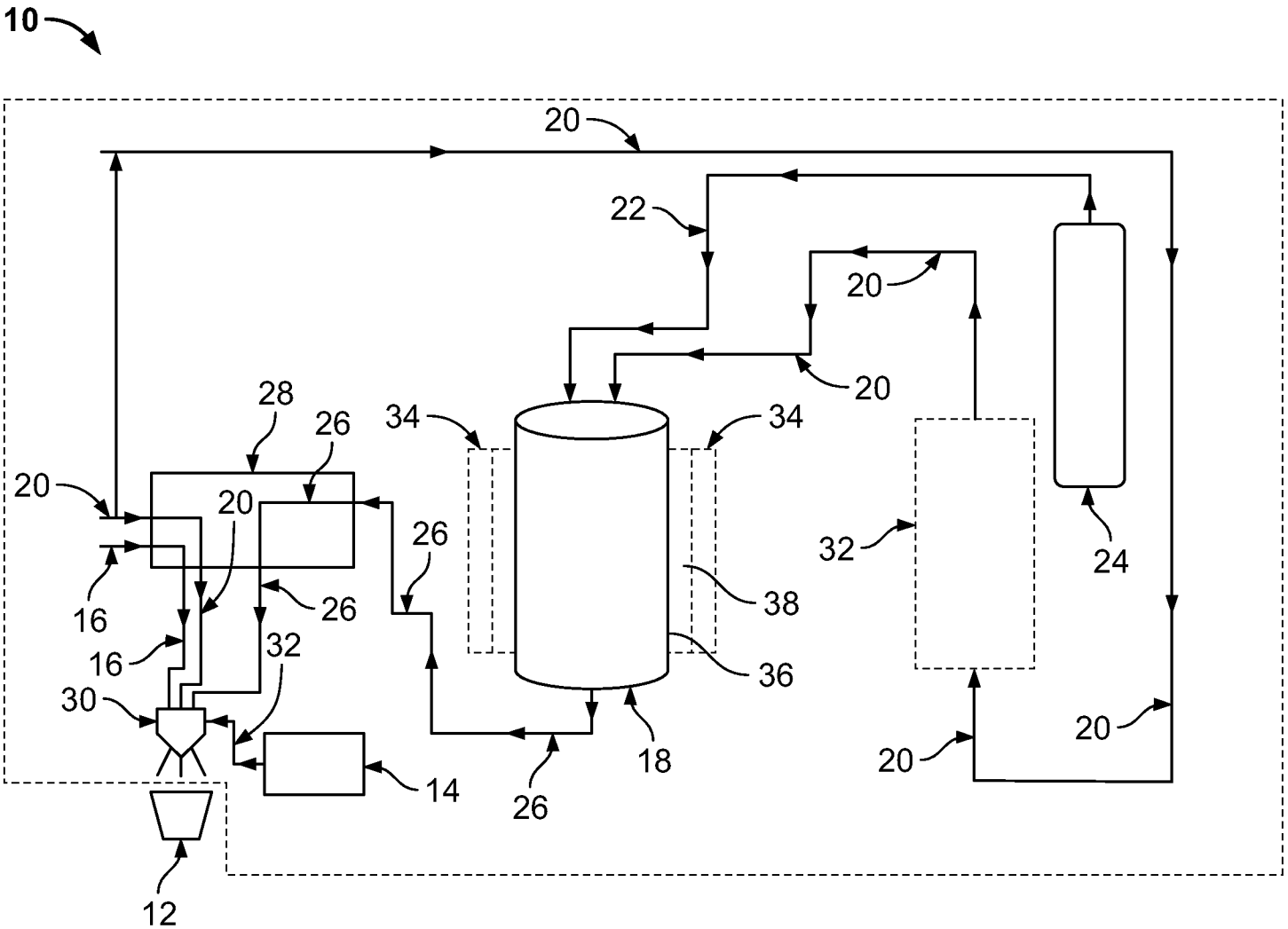
FIG. 1 is a schematic view of an example beverage dispenser.

One example beverage dispenser 10 using a batch process is depicted in FIG. 1. In this example, the beverage dispenser 10 selectively dispenses a carbonated or non-carbonated beverage into a receiving cup 12. This example dispensing system may be found in a commercial or industrial setting. A user interface (not shown) may optionally be utilized to select and individually dispense one or more beverages.

As depicted in FIG. 1, still water and carbon dioxide ($CO_2$) may be provided to a carbonator 18 through a still water input line 20 and a carbon dioxide input line 22. The carbon dioxide may be provided by a carbon dioxide tank 24 used to pump carbon dioxide to the carbonator 18. The carbon dioxide tank 24 may have any size, shape, or configuration. Still water and carbon dioxide may be mixed together in the carbonator 18 to form carbonated water. A carbonated water output line 26 from the carbonator 18 may be used to supply carbonated water in the beverage dispenser 10. The carbonated water may be mixed with various ingredients or beverage components for dispensing a carbonated beverage in the receiving cup 12.

The carbonator 18 may optionally include an outer jacket 34. The outer jacket 34 may be made from an outer layer of an acrylic or similar types of materials and an inner layer of an insulating material with good thermal characteristics.

The carbonator 18 may include a water jacket 36. The water jacket 36 may be a pressurized tank for mixing water and carbon dioxide therein. The carbonator 18 may include a number of concentrate coils positioned within the water jacket 36 to chill beverage concentrate therein. The water jacket 36 may be positioned within the outer jacket 34 and may define a chilling reservoir 38 therebetween.

The example beverage dispenser 10 includes an optional removable water reservoir 32 having a volume of water and/or ice for providing chilled water to the carbonator. The water reservoir 32 may be re-filled with still water via the still water input line 20. The still water exiting the water reservoir 32 may be chilled prior to entering the carbonator 18 via the still water input line 20. The chilling reservoir 38 may be in communication with the water reservoir 32 via a recirculation loop (not shown) thus keeping the water in the chilling reservoir 38 cold so as to chill the water jacket 36 and internal components thereof.

In the beverage dispenser 10, beverages may be dispensed as beverage components in a continuous pour operation whereby one or more selected beverage components continue to be dispensed while a pour input is actuated by a user. The beverage components may be separately stored individually in a container or package.

One type of beverage component is micro-ingredients. The beverage dispenser 10 may include a micro-ingredient supply source 14 for supplying micro-ingredients. Example micro-ingredients include natural and artificial flavors, flavor additives, natural and artificial colors, nutritive or non-nutritive natural or artificial sweeteners, additives for controlling tartness (e.g., citric acid or potassium citrate), functional additives such as vitamins, minerals, or herbal extracts, nutraceutical, or medicaments.

The beverage dispenser 10 may include a macro-ingredient input line 16 for supplying macro-ingredients such as sugar syrup, HFCS (High Fructose Corn Syrup), juice concentrates, and similar types of ingredients.

It should be appreciated that the aforementioned beverage components may be combined, along with other beverage ingredients, to dispense various products which may include carbonated or non-carbonated beverages.

In FIG. 1, macro-ingredients from the macro-ingredient input line 16, still water from the still water input line 20, and/or carbonated water from the carbonated water output line 26 may flow through a cold plate 28 and be chilled prior to entering a nozzle 30. In one embodiment, the micro-ingredient supply source 14 may supply micro-ingredients through a micro-ingredient input line 33 to the nozzle 30. The various ingredients may flow from the nozzle 30 to form a "post mix" beverage. In other words, the ingredients remain separate until they are mixed about or within the nozzle 30 and are dispensed into the receiving cup 12. The nozzle 30 may be of conventional design.

Beverage dispensers including a batch carbonation process similar to FIG. 1 are typically more expensive than an in-line continuous carbonator. Improvements are provided herein. These improvements and techniques are described below.

General Principles of the Present Disclosure

According to the present disclosure, a technique for dispensing beverages including an in-line carbonation system is provided. Herein, the term "in-line" refers to a system that allows carbonation of water on demand, continuously, upon request of a carbonated beverage in a beverage dispenser.

The in-line carbonation system may be provided in beverage dispensers for commercial outlets such as restaurants, bars, and other types of retail establishments. One advantage of such a system is the ability to carbonate water on demand upon request of a carbonated beverage. It can be advantageous to have a carbonation system that includes a removable carbonator for ease of service or replacement.

The present disclosure provides for a beverage dispensing system in which still water may be carbonated in a continuous stream. Unlike a batch process in which carbonated water may be stored and remain stagnant, still water in a continuous stream process may be carbonated on demand directly in a fluid line of a beverage dispenser. As such, carbonated water is available, and fresh carbonation occurs only as required for immediate usage and at desired customized carbonation levels. In such a system, there is no need to store carbonated water.

The carbonated water may be mixed with other beverage components in a nozzle prior to dispensing a selected beverage. As such, a level of carbonation may be customized based upon the selected beverage to be dispensed.

An approach to providing an in-line carbonation system for a beverage dispenser may be to include a hollow fiber membrane carbonator. Unlike conventional carbonators that may include steel containment vessels, a hollow fiber membrane carbonator may include hollow fibers. The hollow fiber membrane carbonator may have a bundle of hollow fibers within an inner shell which is easily accessible and removable. In an in-line carbonation system, the hollow fiber membrane carbonator may be structural compatible to allow differences in gas pressure and water pressure.

The ability to have different water and gas pressures provides an advantage that allows water to either be passed through the hollow fibers or outside the hollow fibers.

The hollow fiber membrane carbonator may be arranged and configured to carbonate still water from a water source. Upon request of a carbonated beverage, still water and $CO_2$ may be pumped to the hollow fiber membrane carbonator for mixing therein to form carbonated water for immediate use to dispense the carbonated beverage in a cup.

During use, the hollow fiber membrane carbonator may be pressurized with carbon dioxide which may flow outside of the hollow fibers. The hollow fibers may have material properties (e.g., pore size, hydrophilic, etc.) that allow carbon dioxide to permeate therethrough and disseminate in the water flowing through the hollow fibers. An example of a hollow fiber membrane carbonator is described in patent application titled, "Hydrophobic Hollow Fiber Membrane Carbonation System," Application Ser. No. 62/149,169, the entirety of which is hereby incorporated by reference.

In other embodiments, carbon dioxide may flow inside of the hollow fibers and the water may flow across the outside of the hollow fibers. The fibers may be configured so that carbon dioxide may freely pass through membrane walls of the hollow fibers, but water cannot. Therefore, it is possible to maintain a water pressure that is higher than the carbon dioxide pressure. The water pressure may be greater than or equal to the carbon dioxide pressure.

For example, when carbon dioxide flows outside of the hollow fibers and water flows inside of the hollow fibers, carbon dioxide will dissolve directly into the water without formation of bubbles if the water pressure exceeds the carbon dioxide pressure. As long as the water pressure inside the hollow fibers is greater than or equal to the carbon dioxide pressure outside the hollow fibers, the formation of bubbles will not occur.

Typically, there will be a significant pressure drop across the hollow fibers of the hollow fiber membrane carbonator. Therefore, the water pressure at the exit of the hollow fiber membrane carbonator will be lower than the water pressure at the entrance of the hollow fiber membrane carbonator. In order to prevent bubble formation, the carbon dioxide pressure is typically greater than the water pressure at the exit of the hollow fiber membrane carbonator.

For example, if the water temperature in the hollow fiber membrane carbonator is 38° F. and the desired level of carbonation is 5.0 volumes, then the carbon dioxide pressure may be set to 34 psig. If the water pressure at the exit of the hollow fiber membrane carbonator is greater than or equal to 34 psig, then the carbon dioxide will be absorbed directly into the water and the water will be carbonated to 5.0 volumes. If the water pressure at the exit of the hollow fiber membrane carbonator is less than 34 psig, then carbon dioxide will enter the water in the form of large bubbles which will cause foaming at a nozzle and a level of carbonation less than 5.0 volumes.

The hollow fibers of the hollow fiber membrane carbonator may optionally be mounted between support blocks that provide a pair of chambers at opposite ends of the hollow fiber membrane carbonator. The support blocks may be made with a cast epoxy and lead to fluid channels within each of the hollow fibers.

A specific approach to providing an in-line carbonation system in a beverage dispenser may be achieved by integrating a hollow fiber membrane carbonator with a cold plate (e.g., chilling reservoir) to provide chilled carbonated water.

The cold plate may include a housing defining beverage material pathways (e.g., coils) extending therethrough. The beverage material pathway may have a flow inlet arrangement and a flow outlet arrangement. The cold plate may include a heat exchanger arrangement configured to chill beverage ingredients passing through the beverage material pathways. The cold plate may also include a carbonation chamber operably positioned in the beverage material pathways of the housing to be in fluid communication therewith. The carbonation chamber may be arranged and configured to removably receive therein a carbonator.

The cold plate may be a flat cast metal such as, but not limited to, cast aluminum surrounding stainless steel tubes. The hollow fiber membrane carbonator may optionally include an outer shell and an inner shell that resides in the outer shell. The outer shell of the hollow fiber membrane carbonator may be constructed of an aluminum or stainless steel material. The outer shell of the hollow fiber membrane carbonator may be cast into the carbonation chamber of the cold plate. The inner shell may be easily removable from the carbonation chamber for service or maintenance of the hollow fiber membrane carbonator. The inner shell may be made from a plastic or similar type of material. Other types of material may be used herein.

Selected Features and Optional Variations

In this section, some example specific features are described. Of course, variations are possible in accord with the presently described techniques. There is no requirement that an assembly, component, feature, or method be applied with all of the features described or depicted herein in order to obtain some advantage according to the present disclosure.

Figure 2:
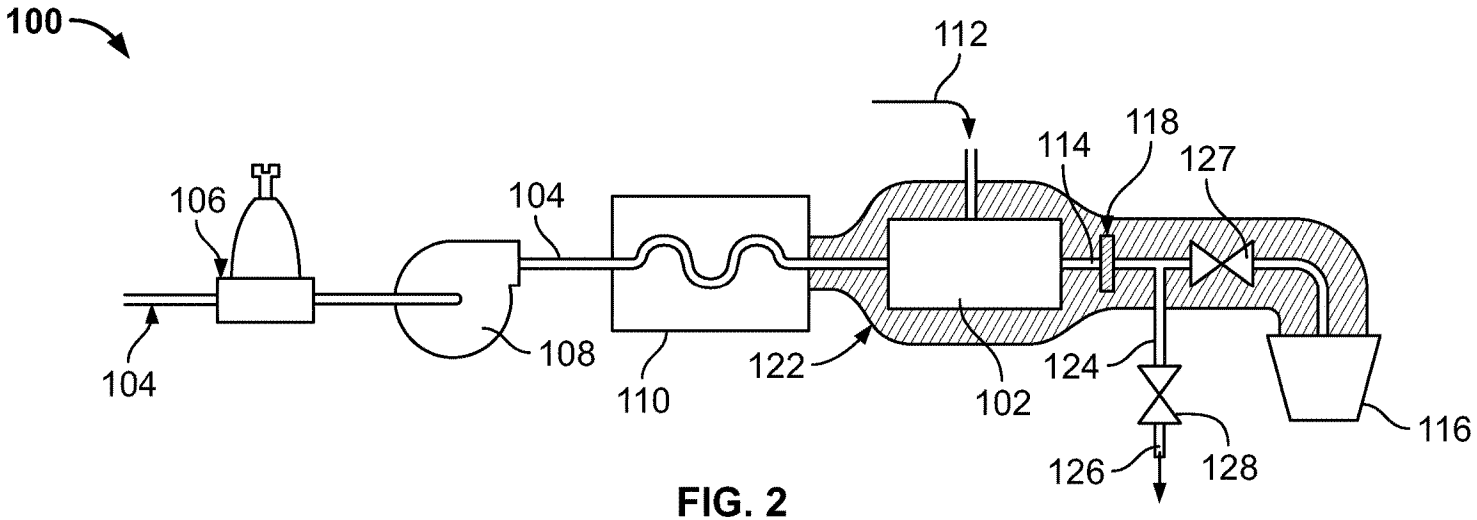
FIG. 2 is a schematic view of a beverage cooling system illustrating the features of a chilling reservoir and a carbonator located externally to and downstream from a chilling reservoir in accordance with the principles of the present disclosure.

A. A hollow fiber membrane carbonator 102 located externally to and downstream from a temperature regulation system 110; FIG. 2.

FIG. 2 is a schematic view of one configuration of a carbonation system 100 integrated with a beverage dispenser. This is an example hollow fiber membrane carbonator in which water flows inside hollow fibers of the hollow fiber membrane carbonator and carbon dioxide flows outside the hollow fibers. Of course, alternatives are possible.

An example of a beverage dispenser is described in U.S. Patent Application Ser. No. 61/991,956, the entirety of which is hereby incorporated by reference. Other beverage dispenser systems may be used. The carbonation system 100 may include a hollow fiber membrane carbonator 102. An example of such a hollow fiber membrane carbonator 102 is described in U.S. Pat. No. 4,927,567, the entirety of which is hereby incorporated by reference. Another example of a hollow fiber membrane carbonator is described in patent application titled, "Hydrophobic Hollow Fiber Membrane Carbonation System," Application Ser. No. 62/149,169, the entirety of which is hereby incorporated by reference. The hollow fiber membrane carbonator 102 is illustrated and described in detail with reference to FIG. 5.

In this example, the carbonation system 100 includes a still water input line 104, a pressure regulator 106 and pump 108 connected to the still water input line 104. The pressure regulator 106 may be of conventional design to maintain consistent water pressure. The pump 108 may be of conventional design and may be a positive displacement pump, a piston pump, and the like. The pump 108 may control the flow of water and deliver water to the hollow fiber membrane carbonator 102.

The carbonation system 100 may include a temperature regulation system 110 (e.g., chilling reservoir, cold plate, cold water bath, etc.). In this example, the hollow fiber membrane carbonator 102 is positioned externally to and downstream from the temperature regulation system 110. In other words, the hollow fiber membrane carbonator 102 is located between the temperature regulation system 110 and the nozzle 116. The hollow fiber membrane carbonator 102 may be easily accessible for maintenance and replacement. Other configurations of the hollow fiber membrane carbonator 102 may be used herein. The temperature regulation system 110 may be mechanically refrigerated or ice cooled.

In one embodiment where the temperature regulation system 110 is a cold plate, the cold plate may include embedded coils or tubes therein for which fluids travel through to be chilled to an appropriate temperature before being served from the dispenser. In other examples, the cold plate may include a plurality of fluidic channels integrated (e.g. monolithically formed) therein.

The cold plate may be positioned within or form a portion of an ice retaining bin such that a layer of ice contacts the cold plate. The cold plate may have a generally planar heat conducting surface. The ice may cause heat exchange between the cold plate and the ice when the ice contacts the planer heat conducting surface. Macro-ingredients, still water, and carbonated water may flow through the cold plate and be chilled as a result of the heat exchange prior to entering a nozzle. Other types of heat exchangers known to those skilled in the art may also be utilized.

In another embodiment, during dispensing, a diluent such as still water flows from the still water input line 104 across the temperature regulation system 110 and to the carbonator 102. A carbon dioxide ($CO_2$) input line 112 may supply $CO_2$ to the carbonator 102 to produce carbonated water which flows through a carbonated water output line 114. The carbonated water may flow from the carbonator 102 to a nozzle 116. Examples of such a nozzle 116 are described in U.S. patent application Ser. No. 14/265,632, the entirety of which is hereby incorporated by reference.

In the depicted example embodiment, carbonated water may be supplied immediately in-line with any beverage dispensing system. Such a configuration allows for customized carbonation levels to be created that could not be obtained utilizing a batch carbonation system. Variable levels of carbonation can be achieved by varying the $CO_2$ pressure from beverage to beverage. The $CO_2$ pressure may remain constant while dispensing a single beverage. Another advantage is the potential cost savings that an in-line carbonator may provide compared to traditional batch carbonators.

In some embodiments, the carbonation system 100 may include a flow restrictor 118 located between an outlet of the carbonator 102 and the nozzle 116 to increase the water pressure on an upstream side of the flow restrictor 118 such that the water pressure at the outlet of the carbonator 102 may exceed the $CO_2$ pressure. Examples of flow restrictors include, but are not limited to, orifices, needle valves, capillary tubes, etc.

Cold water temperatures may result in lower $CO_2$ pressure required to produce the same level of carbonation. In the example embodiment, two possible methods are shown for reducing warming of the elements of the carbonation system 100 downstream of the temperature regulation system 110 between dispenses. One method includes covering the elements by insulation 122. The insulation 122 may, for example, be neoprene foam, polyurethane foam, or the like. A second method may include a diverter channel 124 positioned near the nozzle 116 which may be routed to a drain 126. A diverter valve 128 may periodically open for a brief time to flush cold water through the elements. Examples of diverter valves may be a shut off valve or variable orifice valves. A solenoid valve 127 may be added downstream of the carbonator 102 to control the flow of carbonated water from the carbonator 102 into the nozzle 116. Example solenoid valves may include a shut off valve, a variable orifice valve, or a volumetric valve.

During operation, a user selects a beverage using a user interface (not shown). After the beverage is selected, the user actuates a pour mechanism to dispense the beverage. During dispensing, a diluent such as carbonated water or still water flows from the carbonator 102 or the still water input line 104 to the nozzle 116.

In some embodiments, a macro-ingredient, such as high fructose corn syrup, flowing from a macro-ingredient chamber or source (not shown) may be added for flavor and dispensed about the nozzle 116. Additionally, one or more micro-ingredients flowing from a micro-ingredient chamber or source (not shown) may be added to the system to be dispensed about the nozzle 116. The nozzle 116 may be arranged and configured to combine the flows to mix and the various ingredients may flow from the nozzle 116 to form a "post mix" beverage that may be dispensed into a container such as a cup. The mixing of the beverage may occur prior to, during, and/or following dispense of the flows from the nozzle 116. In other words, the ingredients remain separate until they are mixed about or within the nozzle 116 and are dispensed into the cup.

Figure 3:
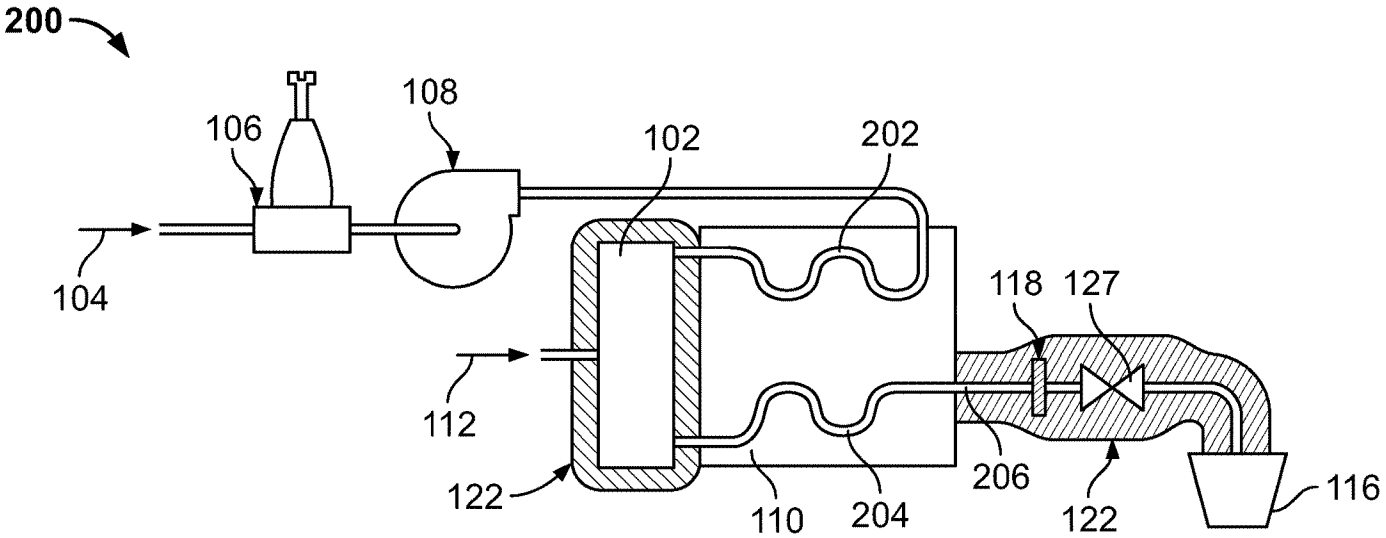
FIG. 3 is a schematic view of an alternative embodiment of a beverage cooling system with a carbonator located externally to the chilling reservoir and between a pre-chill line and a post-chill line in accordance with the principles of the present disclosure.

B. The hollow fiber membrane carbonator 102 located externally to the temperature regulation system 110 (cold plate) and between a pre-chill line 202 and a post-chill line 204; FIG. 3.

Referring to FIG. 3, another example carbonation system 200 is shown with the hollow fiber membrane carbonator 102 positioned externally to the temperature regulation system 110 and between a pre-chill line 202 and a post-chill line 204. This is an example hollow fiber membrane carbonator in which water flows inside hollow fibers of the hollow fiber membrane carbonator and carbon dioxide flows outside the hollow fibers. Alternatively, carbon dioxide may flow inside the hollow fibers and water may flow outside the hollow fibers. Of course, further alternatives are possible. The example carbonation system 200 may have similar features and advantages as the carbonation system 100 of FIG. 2.

The pre-chill and post-chill lines 202, 204 of the carbonation system 200 may be of conventional design. The pre-chill line 202 may be adapted to cool still water before it reaches the hollow fiber membrane carbonator 102. The post-chill line 204 may insure that carbonated water is fully chilled prior to dispensing. Carbonated water may flow from the post-chill line 204 in the temperature regulation system 110 to the nozzle 116 via a carbonated water output line 206.

The hollow fiber membrane carbonator 102 may be positioned in the carbonation system 200 such that the hollow fiber membrane carbonator 102 is easily accessed for service or replacement.

Similar to the carbonation system 100 described above in reference to FIG. 2, the carbonation system 200 depicted in FIG. 3 may also include insulation 122 for reducing warming of elements in the carbonation system 200. As shown, the insulation 122 covers the hollow fiber membrane carbonator 102 and elements downstream of the temperature regulation system 110. The insulation 122 may, for example, be neoprene foam, polyurethane foam, or the like.

During operation, carbon dioxide may be supplied through the carbon dioxide input line 112 to the carbonator 102 to produce carbonated water which flows through the post-chill line 204. A diluent such as still water flows from the still water input line 104 and through the pre-chill line 202 across the temperature regulation system 110 to the carbonator 102. During dispensing of a beverage, the carbonated water or still water flows to the nozzle 116.

Figure 4:
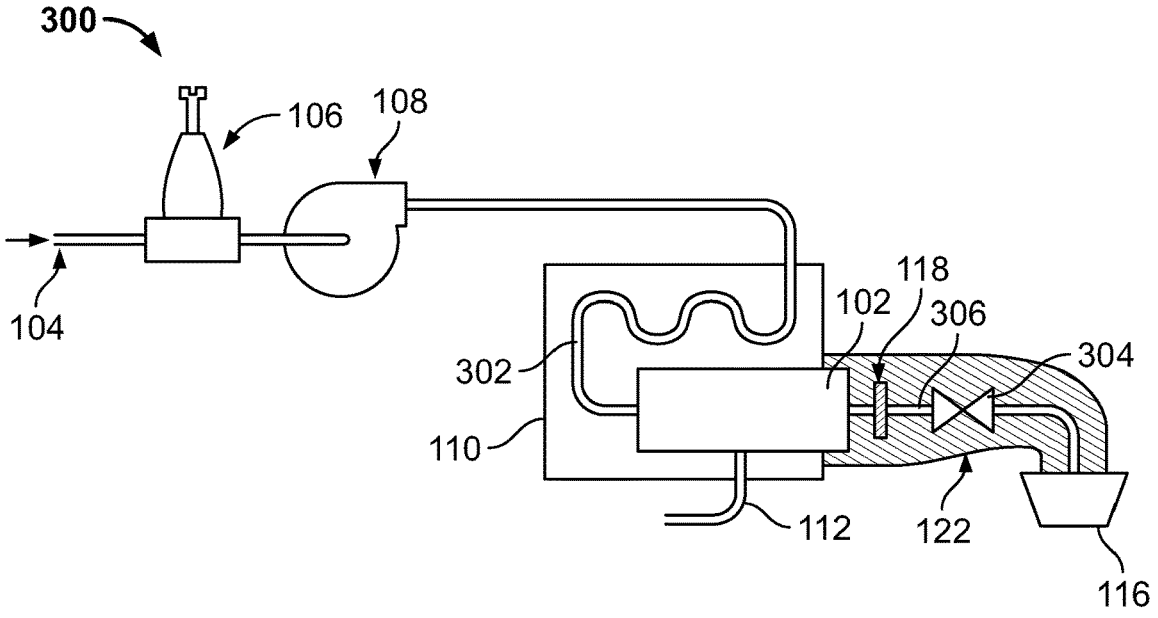
FIG. 4 is a schematic view of an alternative embodiment of a beverage cooling system with a carbonator located internally to a chilling reservoir in accordance with the principles of the present disclosure.

C. The hollow fiber membrane carbonator 102 located within the temperature regulation system 110 and downstream of a chilling circuit 302; FIG. 4.

Referring to FIG. 4, another example carbonation system 300 is shown with the hollow fiber membrane carbonator 102 positioned inside of the temperature regulation system 110. This is an example hollow fiber membrane carbonator in which water flows inside hollow fibers of the hollow fiber membrane carbonator and carbon dioxide flows outside the hollow fibers. Alternatively, carbon dioxide may flow inside the hollow fibers and water may flow outside the hollow fibers. Of course, further alternatives are possible. The example carbonation system 300 may have similar features and advantages as the carbonation system 100 of FIG. 2.

The temperature regulation system 110 may include a chilling circuit 302 therein upstream of the hollow fiber membrane carbonator 102. In this example, carbonated water flows directly from the hollow fiber membrane carbonator 102 to the nozzle 116 via a carbonated water output line 206. A solenoid valve 304 may be added downstream of the hollow fiber membrane carbonator 102 to control the flow of carbonated water from the hollow fiber membrane carbonator 102 into the nozzle 116. Examples of solenoid valves may be a shut off valve, variable orifice valves, or volumetric valves.

In some embodiments, the carbonation system 300 may include a flow restrictor 118 located between an outlet of the carbonator 102 and the nozzle 116 to increase the water pressure on an upstream side of the flow restrictor 118 such that the water pressure at the outlet of the carbonator 102 may exceed the $CO_2$ pressure. Examples of flow restrictors include, but are not limited to, orifices, needle valves, capillary tubes, etc.

Cold water temperatures may result in lower $CO_2$ pressure required to produce the same level of carbonation. In the example embodiment, insulation 122 may be used to cover elements in the carbonation system 300 to reduce warming of the elements. The insulation 122 may, for example, be neoprene foam, polyurethane foam, or the like.

During operation, still water from the still water input line 104 and carbon dioxide from the carbon dioxide input line 112 may be pumped to the hollow fiber membrane carbonator 102 for mixing therein to form carbonated water. The carbonated water may flow through the nozzle 116 for immediate use to dispense a carbonated beverage into a cup.

Figure 5:
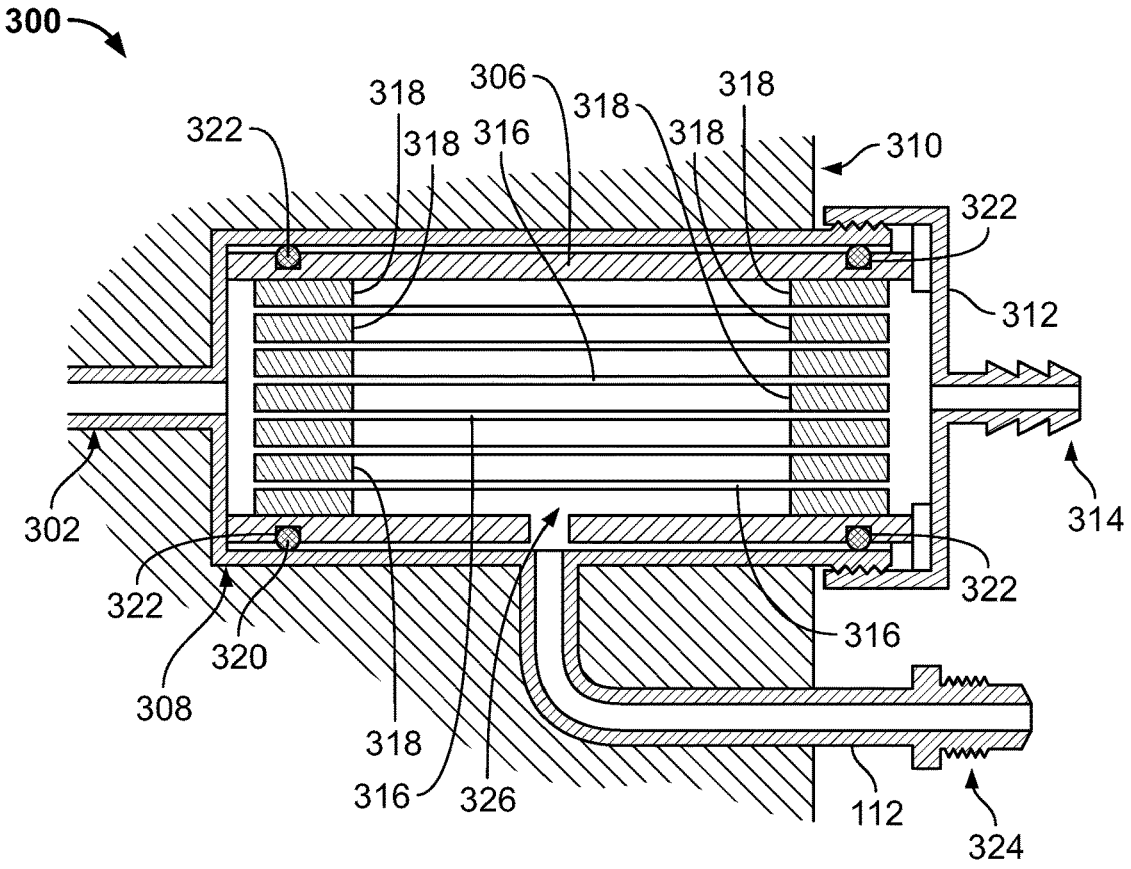
FIG. 5 is a schematic, partially cross-sectional, view of the carbonator integrated with the dispenser system of FIG. 4.

In an example where a beverage dispenser includes the hollow fiber membrane carbonator 102 positioned within a water bath, the hollow fiber membrane carbonator 102 may be accessed by draining the water bath. In another example where the temperature regulation system is a cast aluminum cold plate positioned within an ice retaining bin, the hollow fiber membrane carbonator 102 may be integral with the cold plate. The hollow fiber membrane carbonator 102 may be designed to allow for easy access for service or replacement. FIG. 5 shows the details of such integration.

D. A schematic, partially cross-sectional, view of the hollow fiber membrane carbonator 102 integrated with a cast cold plate 310 (e.g., chilling reservoir); FIG. 5.

FIG. 5 is an example hollow fiber membrane carbonator in which water flows inside hollow fibers of the hollow fiber membrane carbonator and carbon dioxide flows outside the hollow fibers. Of course, alternatives are possible.

In the example embodiment, the hollow fiber membrane carbonator 102 may have any size, shape, or configuration. The hollow fiber membrane carbonator 102 may reside in an inner shell 306 (e.g., support structure). The inner shell 306 may be a replaceable or disposable element. The inner shell 306 may be made from a plastic (e.g., polymer) or similar type of material. Other types of material may be used herein. The inner shell 306 may reside in an outer shell 308 (e.g., carbonation chamber). The outer shell 308 may be cast into a cast cold plate 310. The cast cold plate 310 may be a flat cast metal such as, but not limited to, cast aluminum around stainless steel tubes. The outer shell 308 of the hollow fiber membrane carbonator 102 may also be constructed of an aluminum or stainless steel material.

In this example, the chilling circuit 302 may have still water flowing therethrough and into the hollow fiber membrane carbonator 102. The chilling circuit 302 may be integrated with the outer shell 308 of the hollow fiber membrane carbonator 102.

As depicted, the outer shell 308 is enclosed by a cap 312 located opposite of the chilling circuit 302. Carbonated water may exit through a carbonated water outlet 314. The carbonated water outlet 314 may be integrated with the cap 312. The cap 312 may have any size, shape, or configuration. The cap 312 may be made from any type of substantially rigid thermoplastic materials and the like. The cap 312 may be configured to allow access to the outer shell 308 of the hollow fiber membrane carbonator 102 for service when the cap 312 is removed.

In this embodiment, the hollow fiber membrane carbonator 102 may include a bundle of hollow membrane fibers 316. The hollow membrane fibers 316 may each be mounted between a pair of support members 318 that may provide two open ends of the inner shell 306 for directly exposing the interiors of the hollow membrane fibers 316 to the chilling circuit 302 and the carbonated water outlet 314. O-rings 320 may be seated in grooves 322 and compressed between the inner shell 306 and the outer shell 308 to create a seal. The inner shell 306 with the hollow membrane fibers 316 may be easily accessible for replacement and maintenance.

The hollow fiber membrane carbonator 102 may be in communication with a flow of $CO_2$ through a $CO_2$ input line 112 from a $CO_2$ source via a $CO_2$ valve 324. The $CO_2$ valve 324 may be of conventional design. The $CO_2$ source may be a $CO_2$ tank and the like. The $CO_2$ may flow through the $CO_2$ input line 112 and into the hollow fiber membrane carbonator 102 via a $CO_2$ port 326.

During use, still water may flow around or across the outside of hollow membrane fibers 316 while $CO_2$ flows inside the hollow membrane fibers 316. In other embodiments, still water may flow through the hollow membrane fibers 316, but not pass through membrane walls of the hollow membrane fibers 316. When still water is passed through the hollow membrane fibers 316, $CO_2$ may flow around the outsides of the hollow membrane fibers 316 and pass through membrane walls of the hollow membrane fibers 316 to mix with the still water. Such a configuration allows for the water pressure to be maintained higher than the $CO_2$ pressure.

Figure 6:
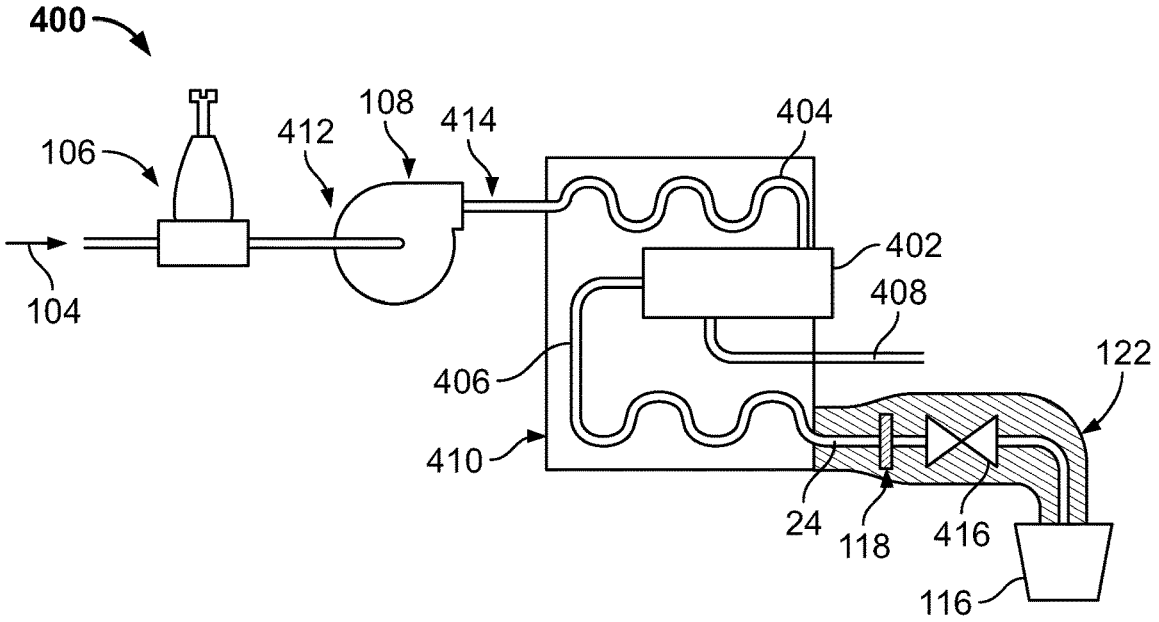
FIG. 6 is a schematic view an alternative embodiment of a beverage cooling system with a carbonator located internally to a chilling system and between a pre-chill and a post-chill line in accordance with the principles of the present disclosure.

E. A hollow fiber membrane carbonator 402 integrated with a temperature regulation system 410 (e.g., chilling reservoir, cast cold plate) and between a pre-chill line 404 and a post-chill line 406; FIG. 6.

Referring to FIG. 6, another example carbonation system 400 is shown with the hollow fiber membrane carbonator 402 positioned inside of the temperature regulation system 410 (e.g., cold plate, chiller). This is an example hollow fiber membrane carbonator in which water flows inside hollow fibers of the hollow fiber membrane carbonator and carbon dioxide flows outside the hollow fibers. Alternatively, carbon dioxide may flow inside the hollow fibers and water may flow outside the hollow fibers. Of course, further alternatives are possible. The example carbonation system 400 may have similar features and advantages as the carbonation system 100 of FIG. 2.

The temperature regulation system 410 may include a pre-chill line 404 as a still water inlet line and a post-chill line 406 as an outlet for carbonated water. The pre-chill and post-chill lines 404, 406 may be of conventional design. The temperature regulation system 410 may be of any conventional construction and serves to chill water in the pre-chill line 404 and the post-chill line 406 to enhance carbonation.

Water may be supplied to the carbonation system 400 from a convenient water source and may be delivered to the carbonator 402 under a predetermined pressure by a pump 108. The pump 108 may be of conventional design. The inlet 412 of the pump may be connected with the water source and a discharge 414 of the pump 108 may be connected with the pre-chill line 404.

The pre-chill line 404 may be adapted to pass through the temperature regulation system 410. The pre-chill line 404 may cool still water before it reaches the hollow fiber membrane carbonator 402. Carbonated water may flow to the nozzle 116 via the post-chill line 406 in the temperature regulation system 410. The post-chill line 406 may insure that the water is fully chilled prior to dispensing.

The carbonation system 400 may include a tubular member 408 which forms a conduit for the flow of $CO_2$ to the hollow fiber membrane carbonator 402. The tubular member 408 is adapted to receive $CO_2$ gas from a source of $CO_2$. The gas may be supplied from a conventional container or tank to which the tubular member 408 may be connected to deliver $CO_2$ gas when carbonated water is being dispensed.

A solenoid valve 416 may be added downstream of the hollow fiber membrane carbonator 402 to control the flow of carbonated water flowing from the hollow fiber membrane carbonator 402 into the nozzle 116.

As described above with reference to the hollow fiber membrane carbonator 102, the integrated hollow fiber membrane carbonator 402 may be easily accessed for service or replacement. Details of the integration of the hollow fiber membrane carbonator 402 are described with reference to FIG. 7.

Figure 7:
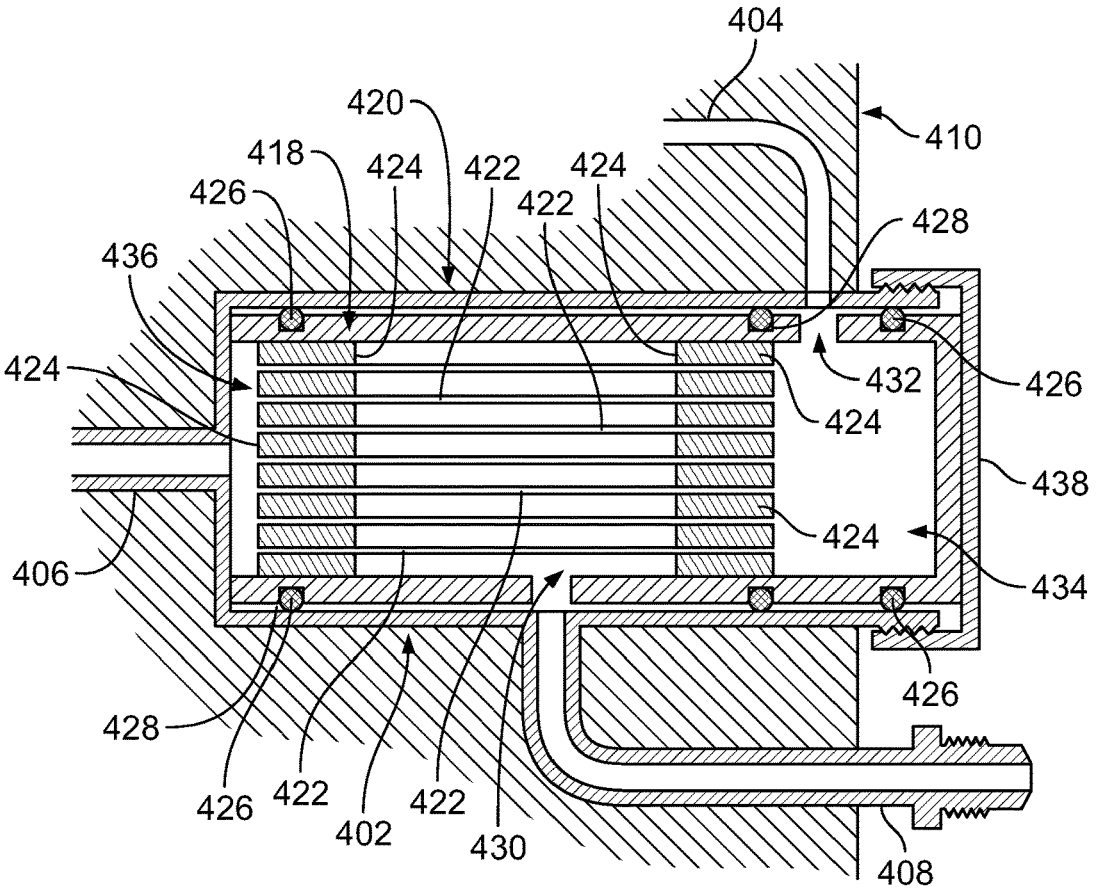
FIG. 7 is a schematic, partially cross-sectional, view of a carbonator integrated with a beverage cooling system in accord with FIG. 6.

F. A schematic, partially cross-sectional, view of the hollow fiber membrane carbonator 402 integrated with a refrigerator system (e.g., cold plate with chilling reservoir) between the pre-chill line 404 and the post-chill line 406; FIG. 7.

Referring to FIG. 7, a schematic, partially cross-sectional, view of the example hollow fiber membrane carbonator 402 integrated with the temperature regulation system 410 is shown. This is an example hollow fiber membrane carbonator in which water flows inside hollow fibers of the hollow fiber membrane carbonator and carbon dioxide flows outside the hollow fibers. Alternatively, carbon dioxide may flow inside the hollow fibers and water may flow outside the hollow fibers. Of course, further alternatives are possible. In this embodiment, the hollow fiber membrane carbonator 402 may have any size, shape, or configuration. The hollow fiber membrane carbonator 402 may reside in an inner shell 418. The inner shell 418 may be a replaceable or disposable element. The inner shell 418 may be made from a plastic or similar type of material. Other types of material may be used herein.

The inner shell 418 may reside in an outer shell 420. The outer shell 420 may be cast into the temperature regulation system 410. The temperature regulation system 410 may be a flat cast metal such as, but not limited to, cast aluminum around stainless steel tubes. The outer shell 420 of the hollow fiber membrane carbonator 402 may also be constructed of an aluminum or stainless steel material.

In this example, the pre-chill line 404 may have still water flowing therethrough and into the hollow fiber membrane carbonator 402. The pre-chill line 404 may be integrated with the outer shell 420 of the hollow fiber membrane carbonator 402.

In this embodiment, the hollow fiber membrane carbonator 402 may include a bundle of hollow membrane fibers 422. The hollow membrane fibers 422 may each be mounted between a pair of support members 424. O-rings 426 may be seated in grooves 428 and compressed between the inner shell 418 and the outer shell 420 to create a seal.

The hollow fiber membrane carbonator 402 may be in communication with a flow of $CO_2$ from a $CO_2$ source via the tubular member 408. The tubular member 408 is shown integrated with the outer shell 420 of the hollow fiber membrane carbonator 402. The tubular member 408 may be of conventional design. The $CO_2$ source may be a $CO_2$ tank and the like. The $CO_2$ may flow from the tubular member 408 into the hollow fiber membrane carbonator 402 through a $CO_2$ port 430.

During use, still water may flow through the pre-chill line 404 and into the inner shell 418 via port 432. Water from the still water input line 104 may flow through the hollow membrane fibers 422, but not pass through membrane walls of the hollow membrane fibers 422. As described above with reference to FIG. 5, $CO_2$ may flow around the outsides of the hollow membrane fibers 422 and pass through membrane walls of the hollow membrane fibers 422 to mix with still water inside the hollow membrane fibers 422. Such a configuration allows for the water pressure to be maintained higher than the $CO_2$ pressure.

In other examples, still water may flow around or across the outside of hollow membrane fibers 422 and $CO_2$ may flow inside the hollow membrane fibers 422.

In this embodiment, still water enters the hollow fiber membrane carbonator 402 at a substantially closed end 434 and carbonated water exits the hollow fiber membrane carbonator 402 at a substantially open end 436.

The outer shell 420 of the hollow fiber membrane carbonator 402 may be enclosed by a cap 438 adjacent to the port 432 at the substantially closed end 434. The cap 438 may have any size, shape, or configuration. The cap 438 may be made from any type of substantially rigid thermoplastic materials or metals, such as stainless steel, aluminum, and the like. The cap 438 may be configured to allow access to the outer shell 420 of the hollow fiber membrane carbonator 402 when the cap 438 is removed.

G. General Methods

In accord with the present disclosure, an example method for dispensing a beverage utilizing a disposable hollow fiber membrane carbonator is provided. Unless otherwise indicated, more or fewer operations may be performed than shown in the figure and described herein. Additionally, unless otherwise indicated, these operations may also be performed in a different order than those described herein.

The method generally includes providing a dispenser with an integrated carbonation system having a carbonator and a nozzle. The method includes pumping carbon dioxide and water through the carbonator on opposite sides thereof. The method also includes mixing carbon dioxide and water such that carbonation occurs while dispensing a chosen beverage to the nozzle.

The subject matter described above is provided by way of illustration only and should not be construed as limiting. Various modifications and changes may be made to the subject matter described herein without following the example embodiments and applications illustrated and described, and without departing from the true spirit and scope of the present disclosure, which is set forth in the following claims.

The principles, techniques, and features described herein can be applied in a variety of systems, and there is no requirement that all of the advantageous features identified be incorporated in an assembly, system or component to obtain some benefit according to the present disclosure.

What is claimed is:

1. A chilling reservoir for a beverage dispenser; the chilling reservoir comprising:

a housing defining a first beverage material pathway extending therethrough, the first beverage material pathway having a flow inlet arrangement and a flow outlet arrangement wherein the first beverage material pathway is a coil formed of stainless steel tubing;

a heat exchanger arrangement that is positioned and configured to be operated to chill beverage material passing through the first beverage material pathway; and a carbonation chamber including an outer shell, the outer shell of the carbonation chamber being operably positioned in the first beverage material pathway of the housing, the outer shell of the carbonation chamber being configured to removably receive therein a carbonator;

wherein the chilling reservoir is a cold plate that is formed as a cast metal around the stainless steel tubing.

2. The chilling reservoir of claim 1, wherein the first beverage material pathway and the chilling reservoir are integrated in the housing.

3. The chilling reservoir of claim 1, wherein the flow inlet arrangement extends from the chilling reservoir for connection to at least one source of beverage material.

4. The chilling reservoir of claim 1, wherein the flow outlet arrangement connects to a beverage dispensing valve.

5. The chilling reservoir of claim 1, further comprising a second beverage material pathway.

6. The chilling reservoir of claim 1, wherein the carbonator is a hollow fiber membrane carbonator.

7. The chilling reservoir of claim 6, wherein the hollow fiber membrane carbonator includes a bundle of hollow fibers each mounted between a pair of support members.

8. The chilling reservoir of claim 7, wherein water flows inside the hollow fibers of the hollow fiber membrane carbonator and carbon dioxide flows outside the hollow fibers.

9. A beverage dispensing system comprising:

a dispenser having a nozzle;

a macro-ingredient reservoir in fluid communication with the nozzle;

a pump in fluid communication with the macro-ingredient reservoir;

a chilling reservoir having at least one beverage material pathway extending therethrough with a flow inlet arrangement and a flow outlet arrangement, wherein the chilling reservoir is positioned and configured to be operated to chill beverage material passing through the at least one beverage material pathway, wherein the at least one beverage material pathway is a coil formed of stainless steel tubing;

a carbonation chamber including an outer shell, the outer shell of the carbonation chamber being operably positioned in the at least one beverage material pathway of the chilling reservoir; and a carbonator including a water input, a gas input, and a carbonated water output in fluid communication with the nozzle, the outer shell of the carbonation chamber being configured to removably receive therein the carbonator;

wherein the carbonator is housed in an inner shell, the inner shell residing in the outer shell of the carbonation chamber; and wherein the chilling reservoir is a cold plate that is formed as a cast metal around the stainless steel tubing.

10. The beverage dispensing system of claim 9, wherein the carbonator comprises hollow fibers within a support structure.

11. The beverage dispensing system of claim 10, wherein the hollow fibers are each mounted between a pair of support members.

12. The beverage dispensing system of claim 9, further comprising a flow restrictor device positioned between the carbonator and the nozzle.

13. The beverage dispensing system of claim 9, wherein the water input of the carbonator is integral with the carbonation chamber.

14. The beverage dispensing system of claim 11, wherein water flows inside the hollow fibers and carbon dioxide flows outside the hollow fibers.

15. The beverage dispensing system of claim 11, wherein carbon dioxide flows inside the hollow fibers and water flows outside the hollow fibers.

16. The beverage dispensing system of claim 10, wherein the support structure of the carbonator comprises a polymer material.

17. The beverage dispensing system of claim 9, wherein the carbonation chamber is sealed by a cap that allows access to the carbonation chamber when removed.

18. The beverage dispensing system of claim 17, wherein the carbonated water output is integral with the cap.

* * * * *